US006395361B1

(12) United States Patent
Hara et al.

(10) Patent No.: US 6,395,361 B1
(45) Date of Patent: May 28, 2002

(54) PACKAGE OPENING METHOD AND APPARATUS

(75) Inventors: Akira Hara; Iwao Yamabe, both of Tokyo; Toshisaburo Takagi, Urawa, all of (JP)

(73) Assignee: Baldwin-Japan Ltd., Tokyo (JP)

( * ) Notice: Subject to any disclaimer, the term of this patent is extended or adjusted under 35 U.S.C. 154(b) by 0 days.

(21) Appl. No.: 09/464,910

(22) Filed: Dec. 17, 1999

Related U.S. Application Data

(62) Division of application No. 09/032,961, filed on Mar. 2, 1998.

(30) Foreign Application Priority Data

| | | |
|---|---|---|
| Mar. 7, 1997 | (JP) | 9-070368 |
| Jul. 16, 1997 | (JP) | 9-208507 |
| Oct. 22, 1997 | (JP) | 9-309195 |

(51) Int. Cl.[7] ..... B32B 9/00

(52) U.S. Cl. ..... 428/41.1; 206/800; 219/121.69; 219/121.85; 428/40.9; 428/41.1; 428/41.7; 428/41.8; 428/43; 428/192; 428/906

(58) Field of Search ..... 428/40.1, 40.9, 428/41.1, 41.7, 41.8, 43, 906, 192; 206/800; 219/121.69, 121.85

(56) References Cited

U.S. PATENT DOCUMENTS

| | | | | |
|---|---|---|---|---|
| 4,125,739 A | * | 11/1978 | Bow | 428/41.1 |
| 4,695,493 A | * | 9/1987 | Friedlander | 428/41.1 |

FOREIGN PATENT DOCUMENTS

| | | |
|---|---|---|
| DE | 43 19 790 A1 | 11/1994 |
| EP | 0 731 029 A1 | 9/1996 |
| JP | 63-307030 | 12/1988 |
| JP | 4-311438 | 11/1992 |
| JP | 6-255638 | 9/1994 |
| NL | 9201286 | 7/1992 |
| WO | WO 93/13004 | 7/1993 |

OTHER PUBLICATIONS

European Search Report.

* cited by examiner

*Primary Examiner*—Nasser Ahmad
(74) *Attorney, Agent, or Firm*—Morgan & Finnegan, L.L.P.

(57) ABSTRACT

According to the invention, there is disclosed a method of opening a package including a content wrapped with a wrapper. The method comprises the step of directing a laser beam to the wrapper for cutting the wrapper with the laser beam to open the package. The method further comprises the step of protecting the content from being damaged by the laser beam.

16 Claims, 17 Drawing Sheets

PACKAGE OPENING METHOD AND APPARATUS

This is a divisional of co-pending application Ser. No. 09/032,961 filed Mar. 2, 1998.

BACKGROUND OF THE INVENTION

1. Field of The Invention

The invention relates to a method of opening a package including a content wrapped with a wrapper. The content may comprise a roll including a web of paper wound thereon to form multi-layers, or sheets of paper stacked into multi-layers. The web or sheets may be adapted to be printed or converted. In addition, the invention relates to the structure of the package. The invention further relates to an apparatus for opening the package.

2. Description of Related Art

There has been generally used a roll R including a web of paper wound thereon to form multi-layers, for example in a web-fed press for newspaper or magazine, as shown in FIG. 35 and FIG. 36. The roll R is wrapped with a wrapper W for transportation and storage to form a package P including the roll R therein. The wrapper W keeps the roll R from being damaged. Accordingly, first of all, it is required to cut the wrapper W circumferentially of the package P at the opposite end portions thereof and then cut the wrapper W axially of the package P, to open the package P. The roll R is taken out of the package P and mounted on the web-fed press. The web of paper is fed from the roll R and printed by the web-fed press.

As to the operation to open the package P, it is conventional to manually cut the wrapper W with a knife and a bamboo spatula. An operator manipulates the knife at the opposite end portions of the package P to cut the wrapper W circumferentially of the package P. The operator then inserts the bamboo spatula between the wrapper W and the roll R at one of the opposite end portions of the package P and move the bamboo spatula axially of the package P, to cut the wrapper W axially of the package P.

However, the roll R is very heavy. In addition, the wrapper W generally comprises a wrapping paper which is durable and strong. The wrapping paper is closely fitted on the outer surface of the roll R. It is therefore troublesome to manually and conveniently cut the wrapper W with the knife and the bamboo spatula. Labour and time are required. It has also a problem that the roll R may be damaged by the bamboo spatula inserted between the wrapper W and the roll R and moved axially of the package P. It is a task of extreme difficulty to manually and conveniently cut the wrapper W to open the package P, without damage of the roll R.

There has been heretofore proposed an apparatus for automatically cutting the wrapper to open the package, as disclosed in Japanese Laid-Open Patent Publication No. 311,438 of 1992. The apparatus includes a knife having a portion of T-shaped cross section and equipments for inserting the knife between the wrapper and the roll and moving the knife axially of the package, to cut the wrapper axially of the package. However, the equipments are complicated and expensive. It takes much time to open the package. It has also a problem that the knife is liable to be worn and damaged by the durable and strong wrapping paper. It is therefore required to frequently exchange the knife for new one.

There has been also used sheets of paper stacked into multi-layers, in the sheet-fed press. The sheets are wrapped with a wrapper for transportation and storage to form a package including the sheets therein, like the roll of web. Accordingly, it is required to cut the wrapper to open the package.

As to the web and sheets to be converted by a paper converting machine, it is also required to cut the wrapper to open the package.

It is therefore an object of the invention to provide a new and improved method of opening a package including a content wrapped with a wrapper, and an apparatus therefore, to thereby overcome the above problems.

Another object of the invention is to conveniently cut the wrapper and open the package, without damage of the content.

Other object of the invention is to conveniently cut the wrapper and open the package, without complicated and expensive equipments.

Other object of the invention is to conveniently cut the wrapper and open the package, without taking much time.

Other object of the invention is to conveniently cut the wrapper and open the package, without the problem relating to the wear and damage of knife.

SUMMARY OF THE INVENTION

According to the invention, there is provided a method of opening a package including a content wrapped with a wrapper. The method comprises the step of directing a laser beam to the wrapper for cutting the wrapper with the laser beam to open the package. The method further comprises the step of protecting the content from being damaged by the laser beam.

There is also provided a package to be opened. The package comprises a covering layer of material having a laser beam absorptivity which is lower than that of the wrapper. The covering layer is interposed between the wrapper and the content for covering the content from the laser beam to protect the content from being damaged by the laser beam.

The material may be coated on or impregnated into the inner surface of the wrapper to form the covering layer.

The material may be coated on or impregnated into the outer surface of the content to form the covering layer.

In other embodiment, the content is of multi-layers. The covering layer is interposed between the layers of the content adjacent to the outer surface of the content for covering the content from the laser beam to protect the content from being damaged by the laser beam.

In the embodiment, the material may be coated on or impregnated into at least one layer of the content adjacent to the outer surface to form the covering layer.

The content may comprise a roll including a web of paper wound thereon to form multi-layers, or sheets of paper stacked into multi-layers. The web or sheets may be adapted to be printed or converted. The wrapper may be made of paper, plastic film or fabric.

The covering layer may be formed of a foil of metal.

The covering layer may extend substantially all over the circumference of the content.

The covering layer may comprise an elongated strip. The package may be intended to cut the wrapper with the laser beam along the strip.

In other embodiment, the step of protecting the content comprises the step of utilizing a type of laser beam not capable of cutting the web or sheets. The wrapper comprises a wrapping paper having a laser beam absorptivity which is higher than that of the web or sheets with respect to the type of laser beam to cut the wrapping paper and open the package with the laser beam.

In the embodiment, the wrapping paper may include a material admixed thereinto and having a high absorptivity with respect to the type of laser beam.

The method may further comprise the step of moving the package relative to the laser beam.

In a preferred embodiment, the package is cylindrical. The step of moving the package comprises the step of rotatingly moving the package about the central axis thereof for cutting the wrapper circumferentially of the package at the opposite end portions of the package. The step of moving the package further comprises the step of linearly moving the package axially thereof for cutting the wrapper in the axial direction of the package.

The step of moving the package may comprise the step of linearly moving the package axially thereof while rotatingly moving the package about the central axis thereof for cutting the wrapper spirally.

In another embodiment, the method further comprises the step of sweeping the laser beam over the package which is held in position.

The step of sweeping the laser beam may comprise the step of linearly sweeping the laser beam axially of the package for cutting the wrapper in the axial direction of the package.

There is also provided an apparatus for opening a package. The apparatus comprises support means for supporting the package thereon at a fixed position. The apparatus further comprises a laser beam source for directing a laser beam to the wrapper and linearly sweeping the laser beam over the wrapper to cut the wrapper with the laser beam in the axial direction of the package.

In other embodiment, the apparatus further comprises guide means adapted to guide the support means for linearly movement axially of the package to cut the wrapper with the laser beam in the axial direction of the package.

In case of the package which is cylindrical, the support means may include guide means for guiding the package for rotatingly movement about the central axis thereof on the support means while directing the laser beam to the wrapper, to cut the wrapper circumferentially of the package at the opposite end portions of the package.

The support means may include first drive means for rotatingly moving the package about the central axis thereof on the support means while directing the laser beam to the wrapper, to cut the wrapper circumferentially of the package at the opposite end portions of the package. The apparatus may further comprise second drive means for linearly moving the support means axially of the package to cut the wrapper with the laser beam in the axial direction of the package.

In connection to the covering layer interposed between the content and the wrapper or between the layers of the content adjacent to the outer surface of the content, the apparatus may further comprise detector means for detecting the covering layer, and control means for controlling the first and second drive means in response to a signal from the detector means to direct the laser beam to the package at the position of the covering layer.

In other embodiment, the roll includes a web of paper wound thereon and an adhesive double coated tape which includes two adhesive layers formed on the opposite sides thereof and a release agent double coated paper adhered to one of the adhesive layers, the other adhesive layer being adhered to the end of the web. The adhesive double coated tape further includes a covering layer of material having a laser beam absorptivity which is lower than that of the wrapper for covering the roll from the laser beam to protect the roll from being damaged by the laser beam.

The adhesive double coated tape may be adhered to the end of the web all over the width thereof.

There is also provided an adhesive double coated tape comprising an elongated substrate. Two adhesive layers are formed on the opposite sides of the substrate. A release agent double coated paper is adhered to one of the adhesive layers. A covering layer is formed on one of the opposite sides of the release agent double coated paper, the covering layer being of material having a low absorptivity with respect to a type of laser beam.

The covering layer may be formed on one of the opposite sides of the substrate.

The type of laser beam may comprise $CO_2$ laser beam. The covering layer may comprise a foil of metal such as aluminum.

The covering layer may be adhered to one of the opposite sides of the release agent double coated paper or the substrate.

The covering layer may be coated on one of the opposite sides of the release agent double coated paper or the substrate.

The covering layer may be vapour deposited on one of the opposite sides of the release agent double coated paper or the substrate.

The adhesive double coated tape may comprise an elongated substrate of material having a low absorptivity with respect to a type of laser beam.

The substrate may be made of metal such as aluminum.

In a preferred embodiment, the elongated substrate includes a portion weakened to be torn along a straight tearing line extending longitudinally of the substrate adjacent to one edge thereof. The substrate is free from one of the adhesive layers at least between the tearing line and the one edge of the substrate. An elongated void is formed in and clear of the other adhesive layer along the tearing line.

DETAILED DESCRIPTION OF THE PREFERRED EMBODIMENTS

Figure 1:
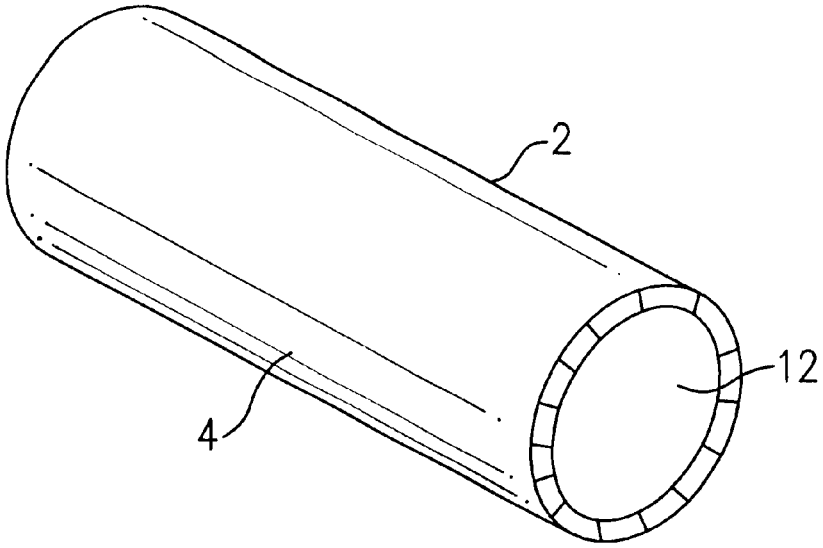
FIG. 1 is a perspective view of a package including a content wrapped with a wrapper according to the invention, the content comprising a roll including a core about which a web of paper is wound to form multi-layers.
Figure 2:
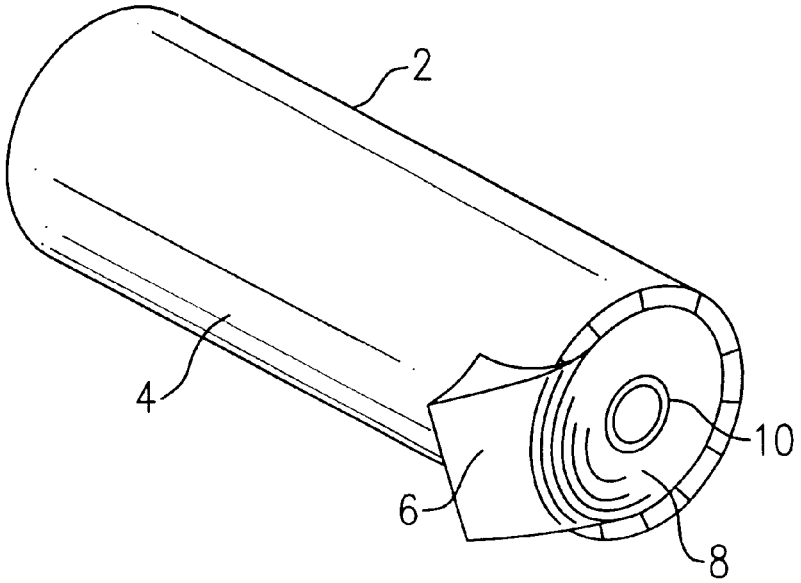
FIG. 2 is a perspective view of the package of FIG. 1 in which an end paper is removed and the wrapper is partially broken to show the web and the core.

Turning now to the drawings, FIG. 1 illustrates a package 2 including a content wrapped with a wrapper 4, according to the invention. The package 2 is cylindrical. The content comprises a roll 6 including a web of paper 8 wound thereon to form multi-layers, as shown in FIG. 2. In the embodiment, the roll 6 includes a core 10 about which the web of paper 8 is wound. The web of paper 8 is adapted to be printed or converted. The wrapper 4 comprises a wrapping paper which is durable and strong. The wrapping paper is closely fitted on the outer surface of the roll 6 and folded along the opposite end surfaces of the roll 6. Two end papers 12 are adhered to the folded portions of the wrapping paper to cover the opposite end surfaces of the roll 6. The wrapper 4 may be made of plastic film or fabric.

The package 2 is intended to direct a laser beam to the wrapper 4 for cutting the wrapper 4 with the laser beam. In addition, the package 2 is arranged to protect the roll 6 from being damaged by the laser beam.

Figure 3:
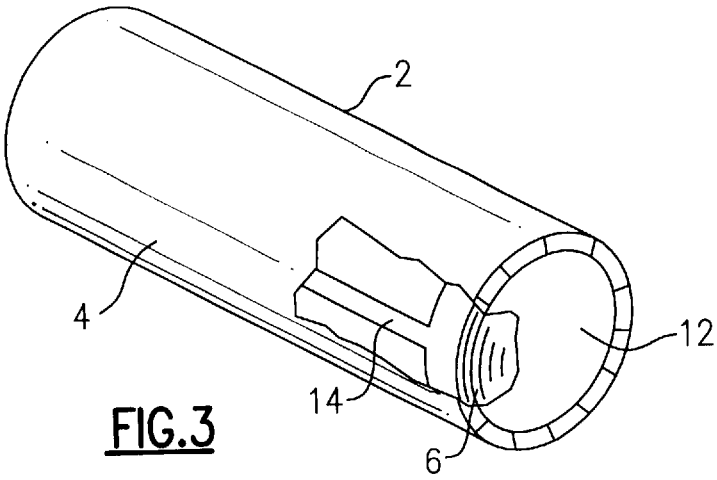
FIG. 3 is a perspective view of a package in which the wrapper is partially broken to show a covering layer interposed between the wrapper and the roll in a preferred embodiment of the invention.
Figure 4:
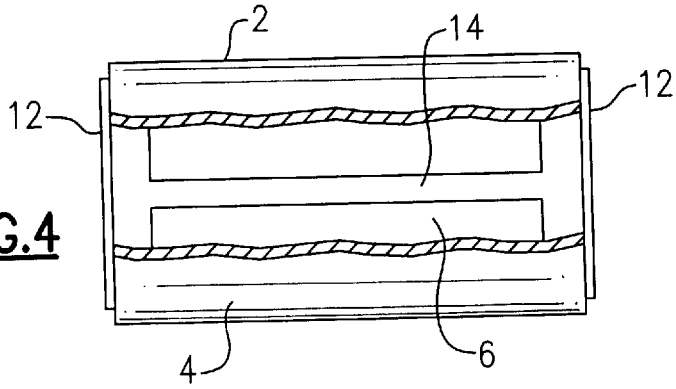
FIG. 4 is a side view of the package of FIG. 3.
Figure 5:
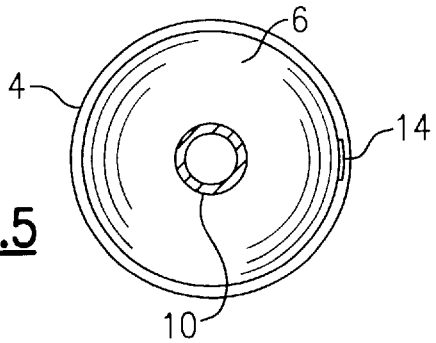
FIG. 5 is a cross sectional view of the package of FIG. 3.

In this connection, in a preferred embodiment of the invention shown in FIG. 3 to FIG. 5, the package 2 includes a intercepting or covering layer 14 of material having a laser beam absorptivity which is lower than that of the wrapper 4. The covering layer 14 is interposed between the wrapper 4 and the roll 6 for intercepting the laser beam between the wrapper 4 and the roll 6. The covering layer 14 therefore covers the roll 6 from the laser beam to protect the roll 6 from being damaged by the laser beam.

The laser beam may comprise $CO_2$ laser beam which can cut the wrapper 4 made of paper, plastic film or fabric. The covering layer 14 may be formed of a foil of metal such as aluminum. The foil may be adhered or bonded to the inner surface of the wrapper 4 to form the covering layer 14. The foil may be adhered or bonded to the outer surface of the roll 6 to form the covering layer 14. Metal has a laser beam absorptivity which is lower than that of the wrapper 4 with respect to $CO_2$ laser beam. Accordingly, the covering layer 14 can cover the roll 6 from the laser beam to protect the roll 6 from being damaged by the laser beam.

An experiment has been made on the roll 6 wrapped with duplicated wrapping papers each having a thickness of 0.1 mm, and the foil of aluminum having a thickness of 0.05 mm and interposed between the duplicated wrapping papers and the roll 6. The experiment has swept a laser beam over the duplicated wrapping papers at a seed of 3 m/sec. It has merely cut the duplicated wrapping papers. The roll 6 has been not damaged at all.

The covering layer 14 may be formed of a material including a powdered metal admixed thereinto. The material may be coated on or impregnated into the inner surface of the wrapper 4 to form the covering layer 14. The material may be coated on or impregnated into the outer surface of the roll 6 to form the covering layer 14. The material may be impregnated into a fabric adhered or bonded to the inner surface of the wrapper 4 or the outer surface of the roll 6 to form the covering layer 14.

Figure 6:
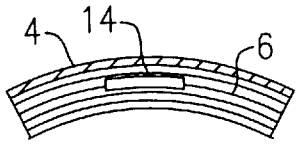
FIG. 6 is a cross sectional view of a package including a covering layer interposed between the layers of web adjacent to the outer surface of the roll in another embodiment.

The covering layer 14 may be interposed between the layers of the web adjacent to the outer surface of the roll 6, as shown in FIG. 6, for covering the roll 6 from the laser beam to protect the roll 6 from being damaged by the laser beam. In the embodiment, the material may be coated on or impregnated into at least one layer of the roll 6 adjacent to the outer surface of the roll 6 to form the covering layer 14.

In addition, the covering layer 14 may comprise an elongated strip which includes a straight portion extending axially of the package 2, as shown in FIGS. 3 and 4. The strip further includes two annular portions extending circumferentially of the package 2 at the opposite end portions of the package 2. The package 2 is intended to cut the wrapper 4 with the laser beam along the strip.

Figure 7:
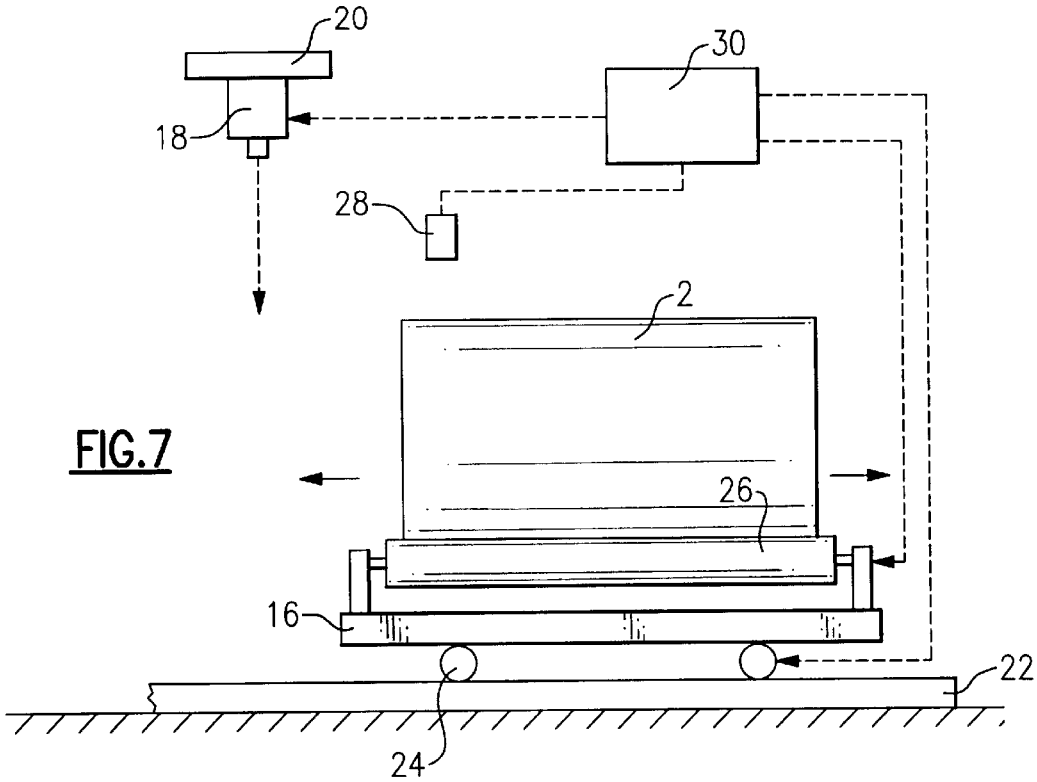
FIG. 7 is an elevational view of an apparatus for opening the package in a preferred embodiment of the invention.
Figure 8:
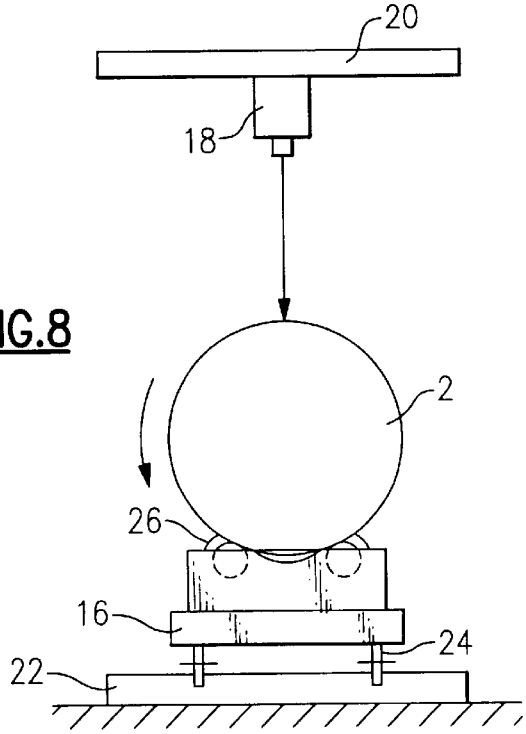
FIG. 8 is a side view of the apparatus of FIG. 7.

FIG. 7 and FIG. 8 illustrate an apparatus for opening the package 2, according to the invention. The apparatus includes support means comprising a carriage 16 for supporting the package 2 thereon. The apparatus further includes a laser beam source 18 mounted on a frame 20 for directing a laser beam to the wrapper 4. In addition, the apparatus includes guide means comprising a guide bed 22 for guide the carriage 16 for linearly movement axially of the package 2. In the embodiment, the carriage 16 includes wheels 24 which are fitted in and rolled along grooves formed in the guide bed 22 to guide the carriage 16 for linearly movement axially of the package 2. The carriage 16 further includes guide means comprising rollers 26 between which the package 2 is supported for guiding the package 2 for rotatingly movement about the central axis thereof on the carriage 16.

Figure 9:
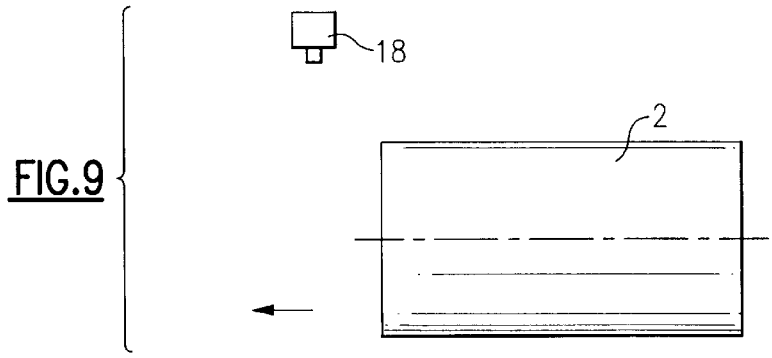
FIG. 9 to FIG. 12 are explanatory views showing the steps of the package in the apparatus of FIG. 7, respectively.
Figure 10:
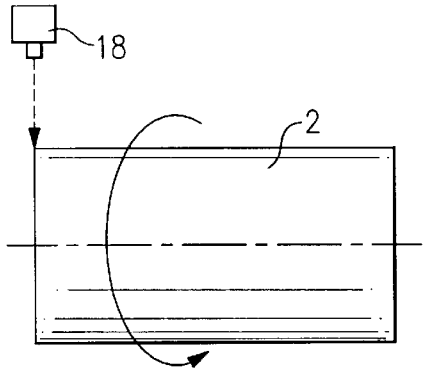

In the apparatus, an operator can linearly move the carriage 16 along with the package 2 axially of the package 2 to position one of the opposite end portions of the package 2 below the laser beam source 18, as shown in FIG. 9 and FIG. 10. The operator then rotatingly moves the package 2 about the central axis thereof and operates the laser beam source 18 for directing the laser beam to the wrapper 4, to cut the wrapper 4 circumferentially of the package 2 at one of the end portions of the package 2. The covering layer 14 includes two annular portions extending circumferentially of the package 2 at the opposite end portions of the package 2, as described previously, so that the operator can cut the wrapper 4 with the laser beam along the annular portion of the covering layer 14. The covering layer 14 therefore covers the roll 6 from the laser beam to protect the roll 6 from being damaged by the laser beam.

Figure 11:
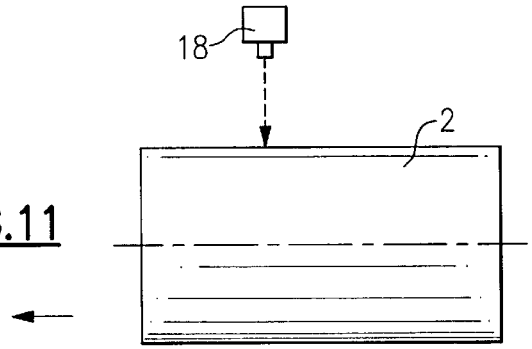
Figure 12:
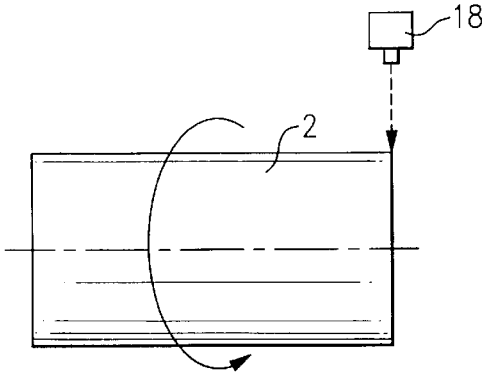

The operator then linearly moves the carriage 16 along with the package 2 axially of the package 2 while directing the laser beam to the wrapper 4, as shown in FIG. 11, to cut the wrapper 4 with the laser beam in the axial direction of the package 2. The covering layer 14 includes a straight portion extending axially of the package 2, as described previously, so that the operator can position the straight portion of the covering layer 14 below the laser beam source 18 to cut the wrapper 4 with the laser beam along the straight portion of the covering layer 14. The covering layer 14 therefore covers the roll 6 from the laser beam to protect the roll 6 from being damaged by the laser beam. The operator then positions the other end portion of the package 2 below the laser beam source 18, as shown in FIG. 12, and rotatingly moves the package 2 about the central axis thereof while directing the laser beam to the wrapper 4, to cut the wrapper 4 circumferentially of the package 2 at the other end portion of the package 2. The operator cuts the wrapper with the laser beam along the annular portion of the covering layer 14 so that the covering layer 14 covers the roll 6 from the laser beam to protect the roll 6 from being damaged by the laser beam.

Accordingly, two annular cut lines are formed at the opposite end portions of the package 2 by the laser beam. In addition, a straight cut line is formed between the annular cut lines by the laser beam. The wrapper 4 can therefore be partially removed from the opposite end portions of the package 2 along the annular cut lines. The operator then engages a tool with the edge of the wrapper 4 formed by the straight cut line and rotatingly moves the package 2 about the central axis thereof, to peel the wrapper 4 off the roll 6.

The apparatus therefore can conveniently cut the wrapper 4 and open the package 2, without damage of the roll 6. It does not involve complicated and expense equipments. In addition, it does not take much time to open the package 2. It has also not a problem relating to the wear of knife.

The roll 6 is then taken out of the package 2 and mounted on a web-fed press for newspaper or magazine. The web of paper 8 is fed from the roll 6 and printed by the web-fed press. The web of paper 8 may be converted by a paper converting machine.

The apparatus can be arranged to automatically cut the wrapper 4 and open the package 2. In the embodiment, the carriage 16 further includes first drive means not shown, but mounted on the carriage 16 and connected to the rollers 26. The apparatus further includes second drive means not shown, but mounted on the carriage 16 and connected to the wheels 24. In addition, the apparatus includes detector means 28 comprising a metal sensor for detecting the covering layer 14, and control means 30 connected to the laser beam source 18, the first and second drive means and the detector means 28.

The control means 30 controls the first and second drive means in response to a signal from the detector means 28 in such a way that the wheels 24 are firstly rotatingly driven by the second drive means to linearly move the carriage 16 axially of the package 2 and positions one of the opposite end portions of the package 2 below the laser beam source 18. The rollers 26 are then rotatingly driven by the first drive means to rotatingly move the package 2 about the central axis thereof. The laser beam source 18 directs the laser beam to the wrapper 4 to cut the wrapper 4 circumferentially of the package 2 at one of the end portions of the package 2. The rollers 26 cooperate with the first drive means, the detector means 28 and the control means 30 to position the straight portion of the covering layer 14 below the laser beam source 18. The wheels 24 are then rotatingly driven by the second drive means to linearly move the carriage 16 axially of the package 2 while directing the laser beam to the wrapper 4, to cut the wrapper 4 with the laser beam in the axial direction of the package 2. At last, the rollers 26 are rotatingly driven again by the second drive means to cut the wrapper 4 circumferentially of the package 2 at the other end portion of the package 2. This can automatically cut the wrapper 4 and open the package 2.

In the apparatus in FIG. 7 and FIG. 8, the wheels 24 and the rollers 26 may be rotatingly moved, to linearly move the package 2 axially thereof while rotatingly moving the package 2 about the central axis thereof for cutting the wrapper 4 spirally. In this connection, the covering layer 14 may include a spiral portion extending axially of and about the package 2 to cut the wrapper 4 with the laser beam along the spiral portion of the covering layer 14. The covering layer 14 may extend substantially all over the circumference of the roll 6.

The apparatus may be arranged to sweep the laser beam over the package 2 which is held in position, to thereby open the package 2. For example, the apparatus may be arranged to rotatingly move the package 2 about the central axis thereof relative to the laser beam for cutting the wrapper 4 circumferentially of the package 2 at the opposite end portions of the package 2, and then linearly sweep the laser beam axially of the package for cutting the wrapper 4 in the axial direction of the package 2.

Figure 13:
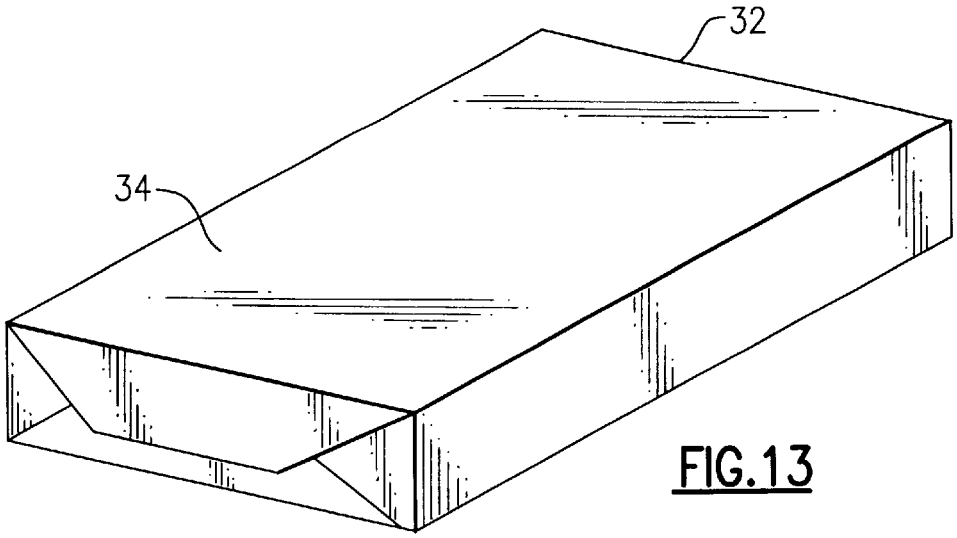
FIG. 13 is a perspective view of a package including a content wrapped with a wrapper according to the invention, the content comprising sheets of paper stacked into multi-layers.
Figure 14:
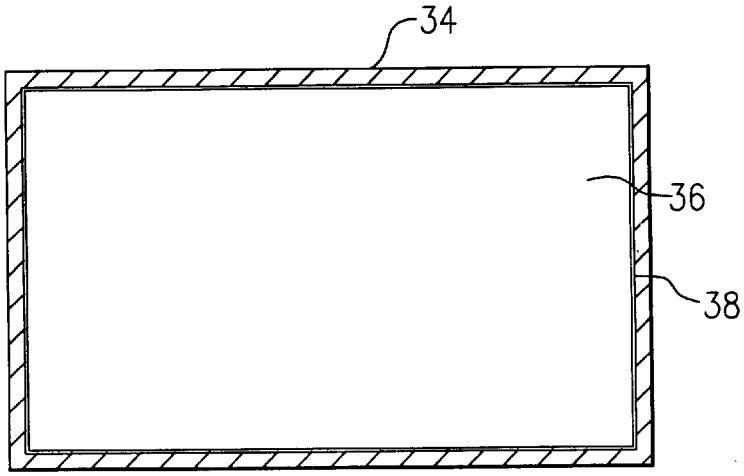
FIG. 14 is a plan and sectional view of the package of FIG. 13.
Figure 15:
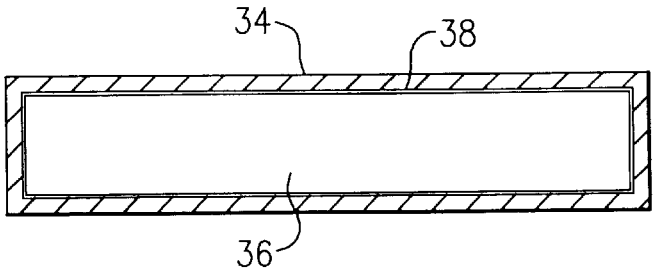
FIG. 15 is a side and sectional view of the package of FIG. 13.

In other embodiment shown in FIG. 13 to FIG. 15, a package 32 includes a content wrapped with a wrapper 34, the content comprising sheets of paper 36 stacked into multi-layers. The sheets of paper 36 are adapted to be printed or converted. The package 32 further includes a covering layer 38 of material having a laser beam absorptivity which is lower than that of the wrapper 34, like the covering layer 14 and the wrapper 4 in FIG. 3. The covering layer 38 is interposed between the wrapper 34 and the sheets of paper 36 to extend substantially all over the circumference of the sheets of paper 36. The covering layer 38 may be adhered or bonded to the inner surface of the wrapper 34 or outer surface of the sheets of paper 36. The material may be coated or impregnated into the inner surface of the wrapper 34 or the outer surface of the sheets of paper 36, to form the covering layer 38.

Figure 16:
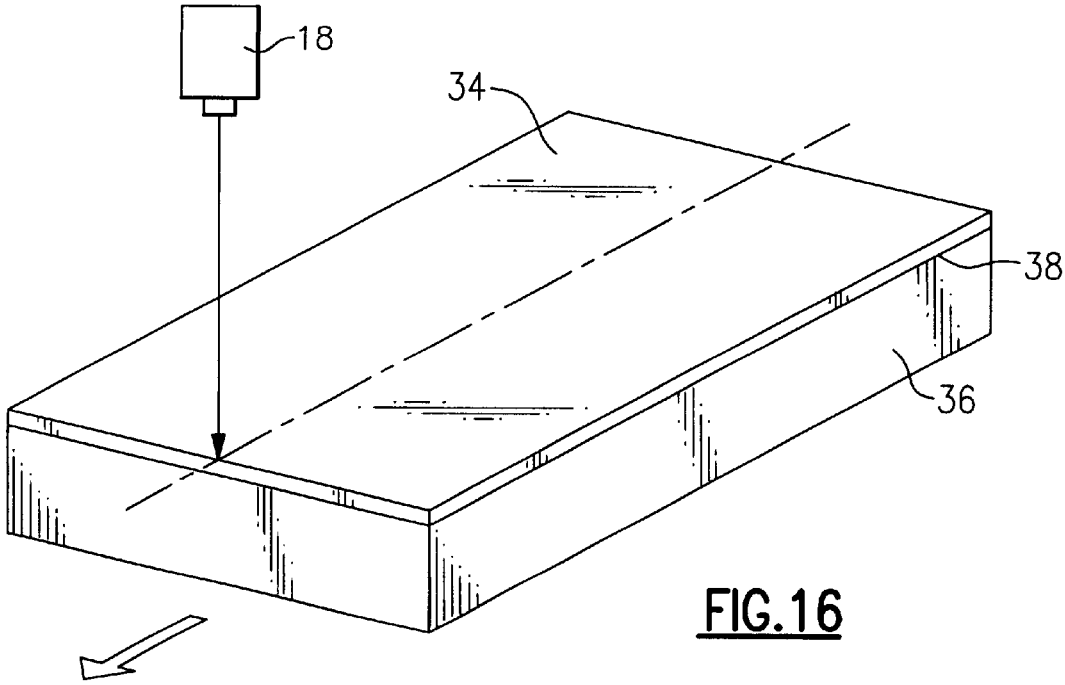
FIG. 16 is an explanatory view showing the step of opening the package in a preferred embodiment of the invention.

The package 32 is intended to linearly move the package 32 longitudinally thereof and direct the laser beam to the wrapper 34 from the laser beam source 18, as shown in FIG. 16, to cut the wrapper 34 and open the package 32. The covering layer 38 covers the sheets of paper 36 from the laser beam to protect the sheets of paper 36 from being damaged by the laser beam.

Figure 17:
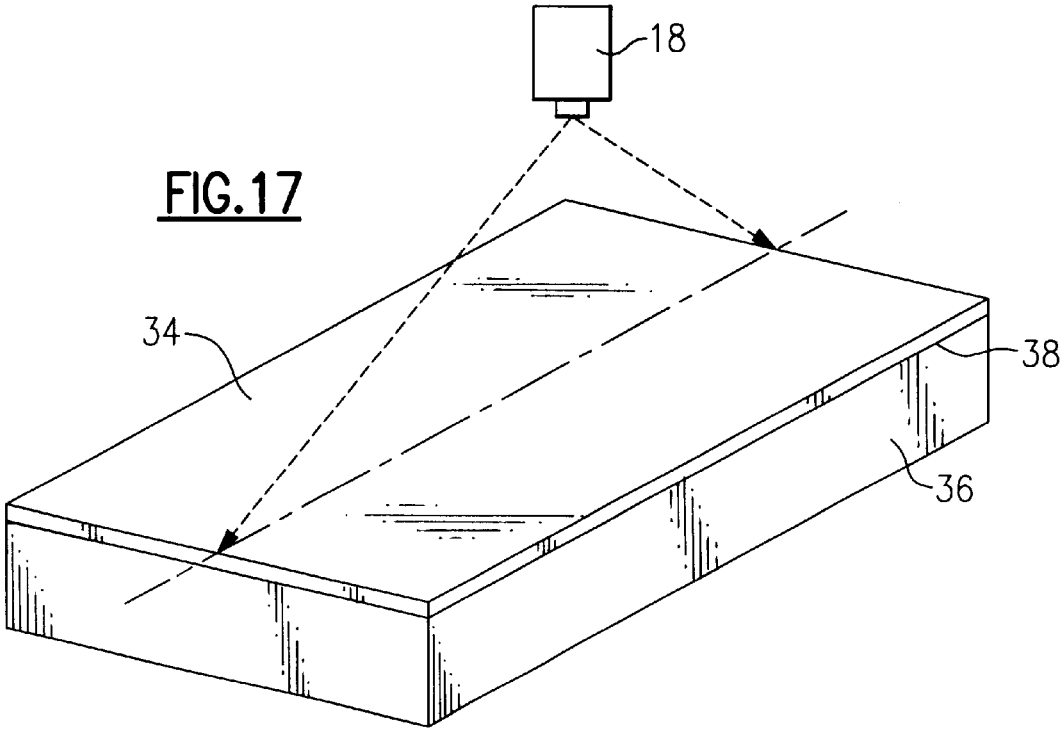
FIG. 17 is an explanatory view showing the step of opening the package in another embodiment.

The laser beam source 18 may include a reflector for reflecting the laser beam toward the wrapper 34. The laser beam source 18 may further include means for rotatingly moving the reflector to sweep the laser beam over the package 32 which is held in position, as shown in FIG. 17. This embodiment can cut the wrapper 34 and open the package 32, without moving the package 32.

As to the package 2 in FIG. 1, it may be arranged to cut the wrapper 4 and open the package 2 with a type of laser beam such as YGA laser beam which is not capable of cutting the web of paper 8. In a preferred embodiment, the wrapper 4 comprises a wrapping paper which includes carbon admixed thereinto. Carbon may be admixed into the wrapping paper in a paper making step. Carbon has a high absorptivity with respect to the type of the laser beam such as YGA laser beam. Accordingly, the wrapping paper has a laser beam absorptivity which is higher than that of the web of paper 4 with respect to the type of the laser beam. It therefore can cut the wrapper 4 and open the package 2 with the type of laser beam. It also can protect the web of paper 8 from being cut or damaged by the laser beam. The wrapping paper may include a material other than carbon, admixed thereinto and having a high absorptivity with respect to the type of laser beam.

As to the package 32 in FIG. 13, the wrapper 34 may also comprise a wrapping paper which includes a material such as carbon admixed thereinto and having a high absorptivity with respect to the type of laser beam such as YGA laser beam, so that the wrapping paper has a laser beam absorptivity which is higher than that of the sheets of paper 36 with respect to the type of the laser beam. This can cut the wrapper 34 and open the package 32 with the type of laser beam, and protect the sheets of paper 36 being damaged by the laser beam, even if no covering layer 38 is interposed between the wrapper 34 and the sheets of paper 36.

Figure 18:
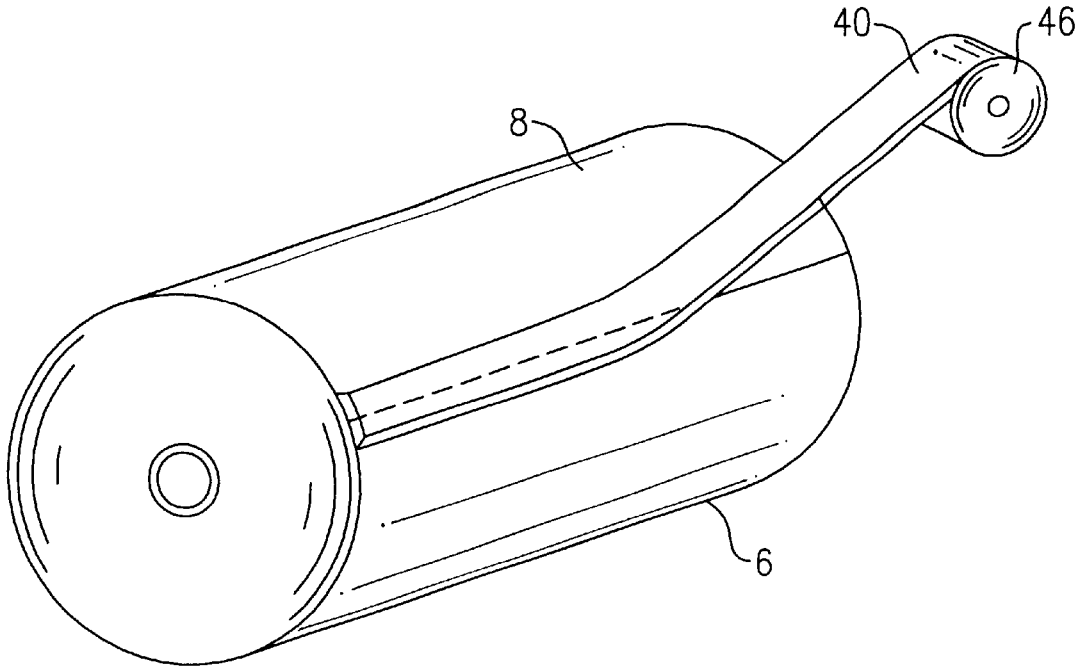
FIG. 18 is a perspective view showing a roll including a web of paper wound thereon and an adhesive double coated tape adhered to the end of the web in a preferred embodiment of the invention.
Figure 19:
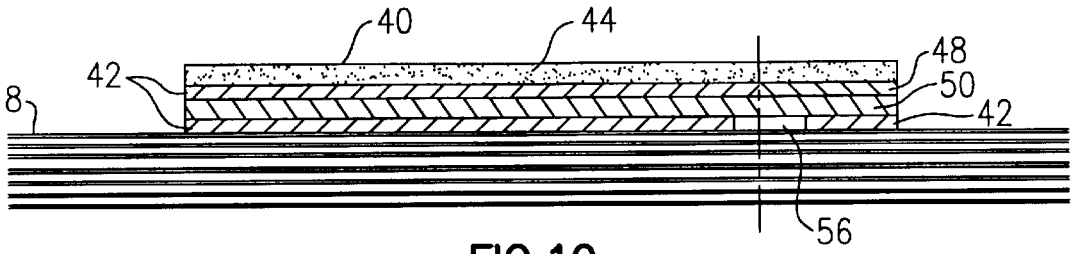
FIG. 19 is a cross sectional view of the roll and the adhesive double coated tape of FIG. 18.

In other embodiment shown in FIG. 18, the package 2 includes a content wrapped with a wrapper 4, the content comprising the roll 6 including the web of paper 8 wound thereon and an adhesive double coated tape 40 which includes two adhesive layers 42 formed on the opposite sides thereof, as shown in FIG. 19. A release agent double coated paper 44 is adhered to one of the adhesive layers 42. The adhesive double coated tape 40 is drawn and supplied from a roll 46 of tape to extend axially of the roll 6, the other adhesive layer 42 being adhered to the end of the web 8. In the embodiment, the adhesive double coated tape 40 is adhered to the end of web 8 all over the width thereof between the opposite end surfaces of the roll 6, and cut into a length at the position of the end surface of the roll 6. The roll 6 and the adhesive double coated tape 40 thereon are then wrapped with the wrapper 4.

The adhesive double coated tape 40 further includes a covering layer 48 of material having a laser beam absorptivity which is lower than that of the wrapper 4 for covering the roll 6 from the laser beam to protect the roll 6 from being damaged by the laser beam. The covering layer 48 is formed on one of the opposite sides of the release agent double coated paper 44. The covering layer 48 is of material having a low absorptivity with respect to a type of laser beam.

Figure 20:
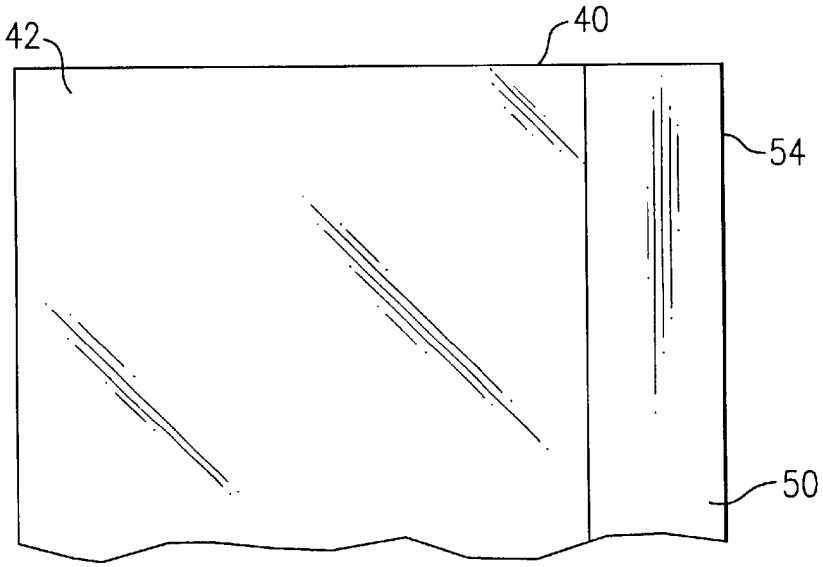
FIG. 20 is a plan view of the adhesive double coated tape of FIG. 19, a release agent double coated paper being removed.
Figure 21:
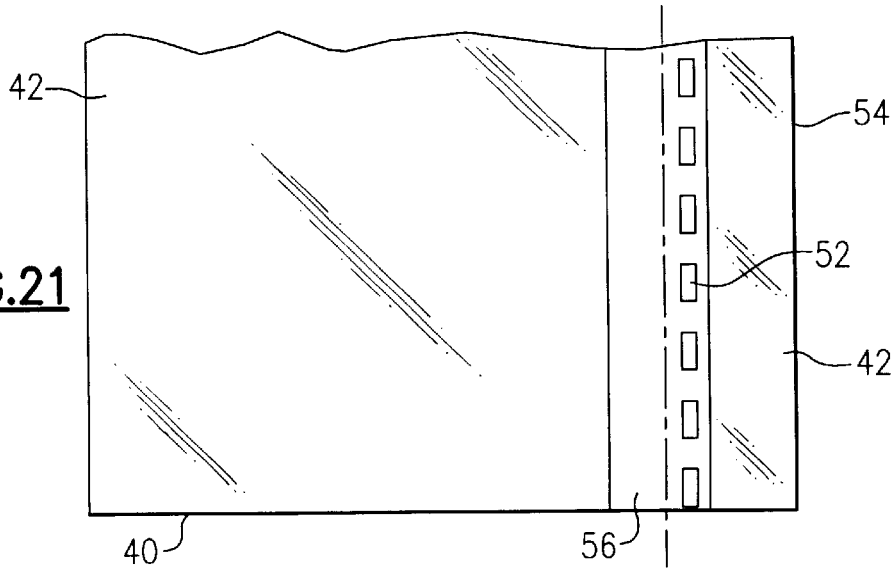
FIG. 21 is a bottom view of the adhesive double coated tape of FIG. 19.

In the embodiment, the adhesive double coated tape 40 has a width of about 10 cm, and extends between the end of the web 8 and the outer surface of the roll 6. The adhesive double coated tape 40 is adhered to the end of the web 8 and the outer surface of the roll 6 to join the end of the web 8 and the outer surface of the roll 6. In addition, the adhesive double coated tape 40 includes an elongated substrate 50 made of paper, fabric or plastic film, the adhesive layers 42 being formed on the opposite sides of the substrate 50. The substrate 50 includes a portion weakened by perforations 52 to be torn along a straight tearing line extending longitudinally of the substrate 50 adjacent to one edge 54 thereof, as shown in FIG. 21. The substrate 50 is free from one of the adhesive layers 42 on the outer side of the substrate 50 at least between the tearing line having the perforations 52 and the one edge 54 of the substrate 50, as shown in FIG. 20. The covering layer 48 is formed on the inner side of the release agent double coated paper 44 to have a width of about 3 cm, in stead of the adhesive layer 42. In addition, an elongated void 56 is formed in and clear of the other or inner adhesive layer 42 along the tearing line, at a distance of about 1.5 cm from the one edge 54 of the substrate 50. The void 56 has a width of about 1.5 cm. The other adhesive layer 42 is adhered to the end of the web 8 and the outer surface of the roll 6 to position the void 56 between the end of the web 8 and the outer surface of the roll 6.

Figure 22:
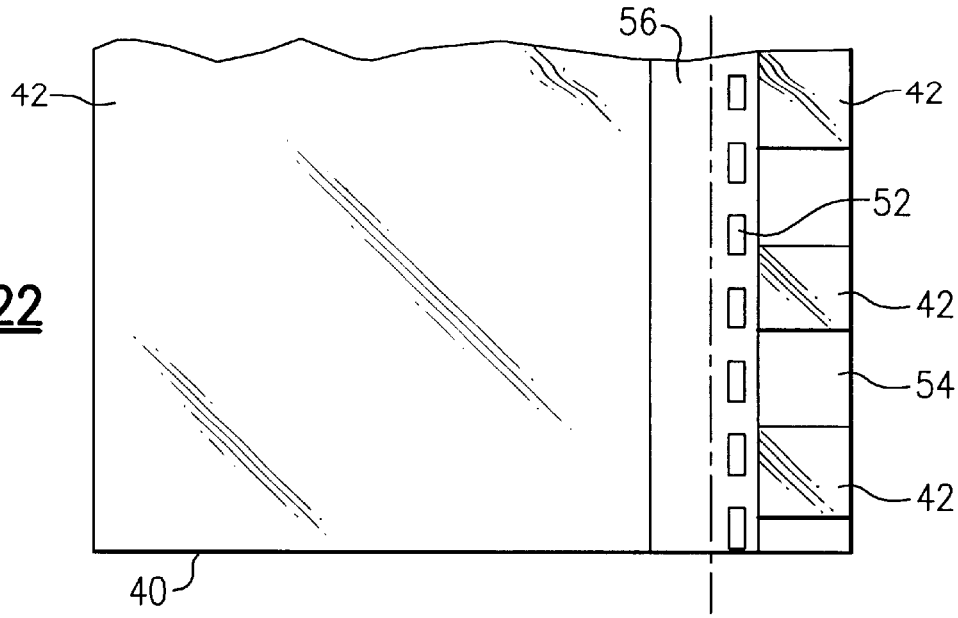
FIG. 22 is a bottom view of a adhesive double coated tape in another embodiment.

The adhesive layers 42 may include portions formed between the one edge 54 of the substrate 50 and the void 56 and spaced from each other at a distance in the longitudinal direction of the adhesive double coated tape 40, as shown in FIG. 22.

Figure 23:
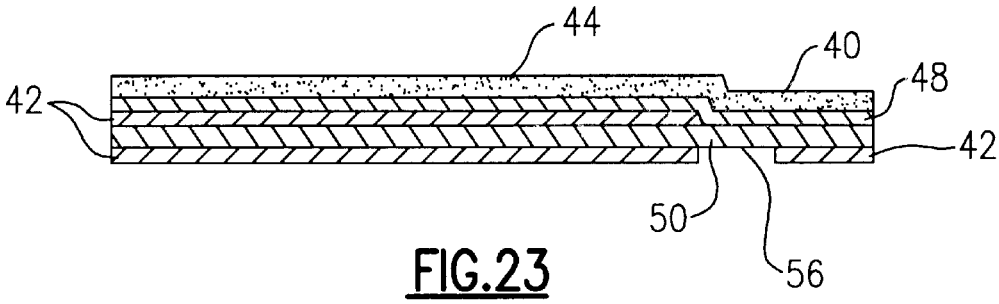
FIG. 23 is a cross sectional view of an adhesive double coated tape in other embodiment.

The covering layer 48 may be formed all through the inner side of the release agent double coated paper 44, as shown in FIG. 23. In the embodiment, the covering layer 48 includes a release agent coated on the inner side thereof which is adhered to the outer adhesive layer 42 of the substrate 50.

Figure 24:
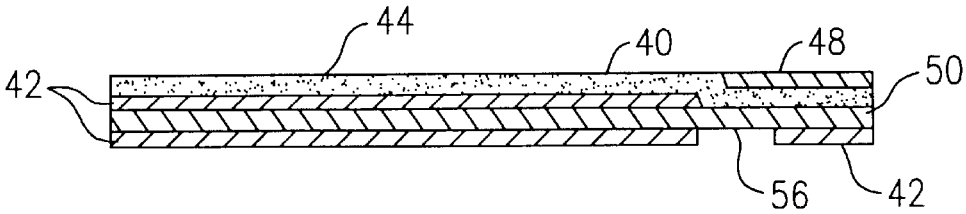
FIG. 24 is a cross sectional view of an adhesive double coated tape in other embodiment.

The covering layer 48 may be formed on the outer side of the release agent double coated paper 44, as shown in FIG. 24, to have a width of about 3 cm, in the portion free from one of the adhesive layers 42 on the outer side of the substrate 50. The covering layer 48 includes a release agent coated on the outer surface thereof.

Figure 25:
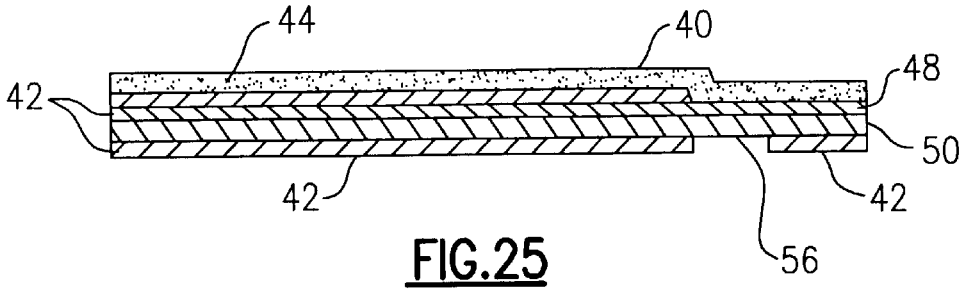
FIG. 25 is a cross sectional view of an adhesive double coated tape in other embodiment.

The covering layer 48 may be formed on the outer side of the substrate 50, as shown in FIG. 25. The outer adhesive layer 42 is formed on the covering layer 48, the release agent double coated paper 44 being adhered to the outer adhesive layer 42.

The package 2 may be intended to direct a type of laser beam comprising $CO_2$ laser beam, to the wrapper 4. In the case, the covering layer 48 may comprises a foil of metal such as aluminum.

The covering layer 48 may be adhered to one of the opposite sides of the release agent double coated paper 44 or the substrate 50. The covering layer 48 may be coated on one of the opposite sides of the release agent double coated paper 44 or the substrate 50. The covering layer 48 may be vapour deposited on one of the opposite sides of the release agent double coated paper 44 or the substrate 50.

Figure 26:
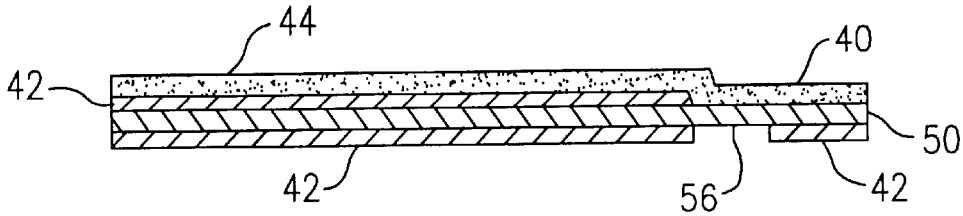
FIG. 26 is a cross sectional view of an adhesive double coated tape in other embodiment.

The adhesive double coated tape 40 may include an elongated substrate 50 of material having a low absorptivity with respect to a type of laser beam, as shown in FIG. 26, for covering the roll 6 from the laser beam to protect the roll 6 from being damaged by the laser beam, without the covering layer 48. The package 2 may be intended to direct a type of laser beam comprising $CO_2$ laser beam, to the wrapper 4. The substrate 50 may be made of metal such as aluminum.

Figure 27:
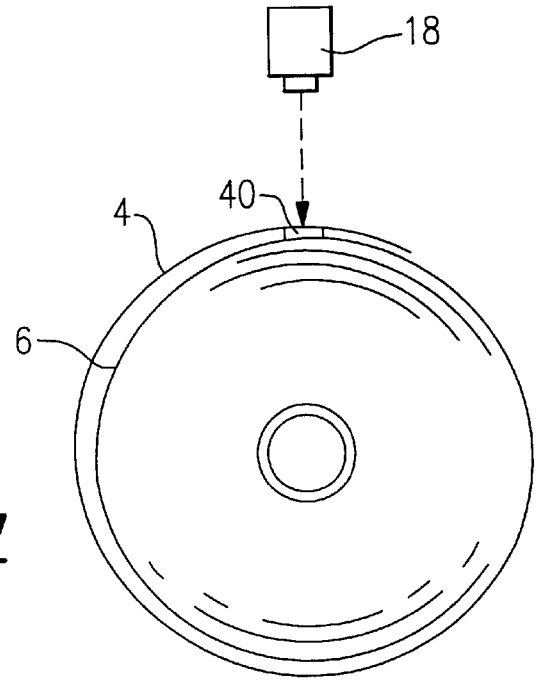
FIG. 27 is an explanatory view showing the step of opening a package including the roll and the adhesive double coated tape.

The laser beam source 18 is arranged to direct the laser beam to the wrapper 4 along the adhesive double coated tape 40, as shown in FIG. 27, to cut the wrapper 4 and open the package 2. The covering layer 48 covers the roll 6 from the laser beam. In the embodiment shown in FIG. 26, the substrate 50 covers the roll 6 from the laser beam.

Figure 28:
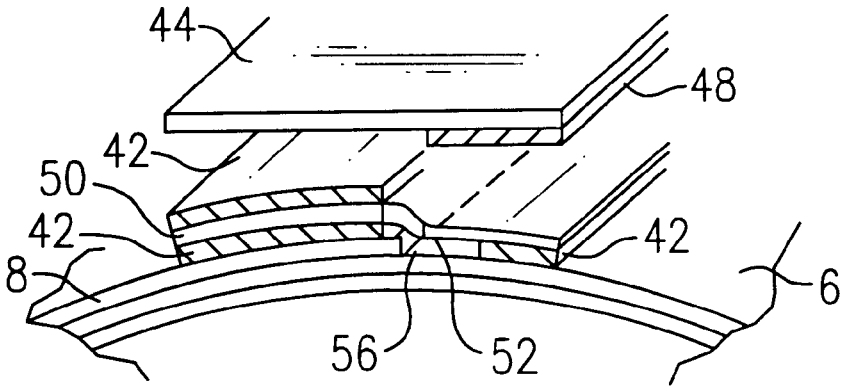
FIG. 28 is an explanatory view showing the release agent double coated paper removed from the adhesive layer of the adhesive double coated tape of FIG. 27.

The roll 6 can therefore be taken from the package 2. An operator then peels the release agent double coated paper 44 off the adhesive layer 42 of the substrate 50, as shown in FIG. 28.

Figure 29:
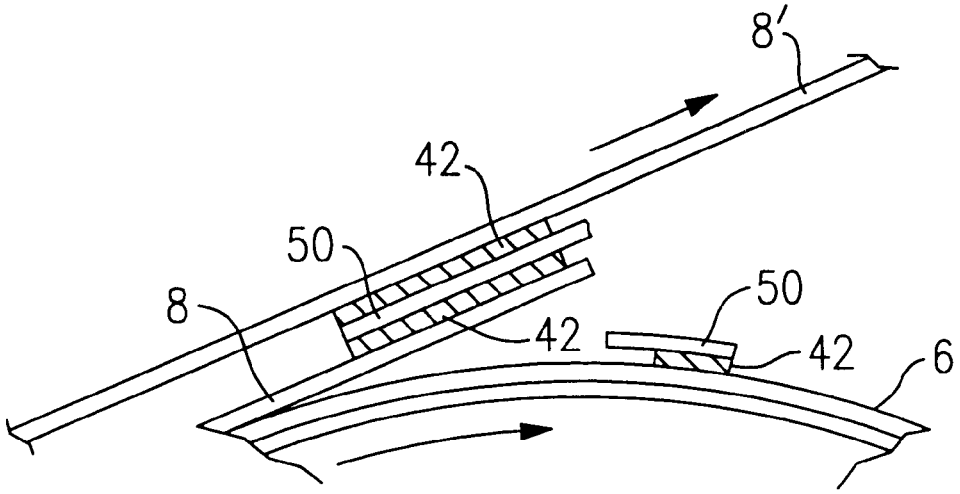
FIG. 29 is an explanatory view showing another web of paper adhered to the adhesive layer of the adhesive double coated tape of FIG. 28.

The web of paper 8 is intended to be printed in a web-fed press. The web of paper 8 may be intended to be converted in a converting machine. The web-fed press or converting machine includes an apparatus for feeding the web of paper 8, the roll 6 being mounted on the apparatus. In the apparatus, another web of paper 8' is adhered to the adhesive layer 42 of the adhesive double coated tape 40 to join the two webs of paper 8, 8' together, as shown in FIG. 29. The substrate 50 is then torn along the tearing line having the perforations 52 by a tension in the webs of paper 8, 8' when the webs of paper 8, 8' are fed.

Figure 30:
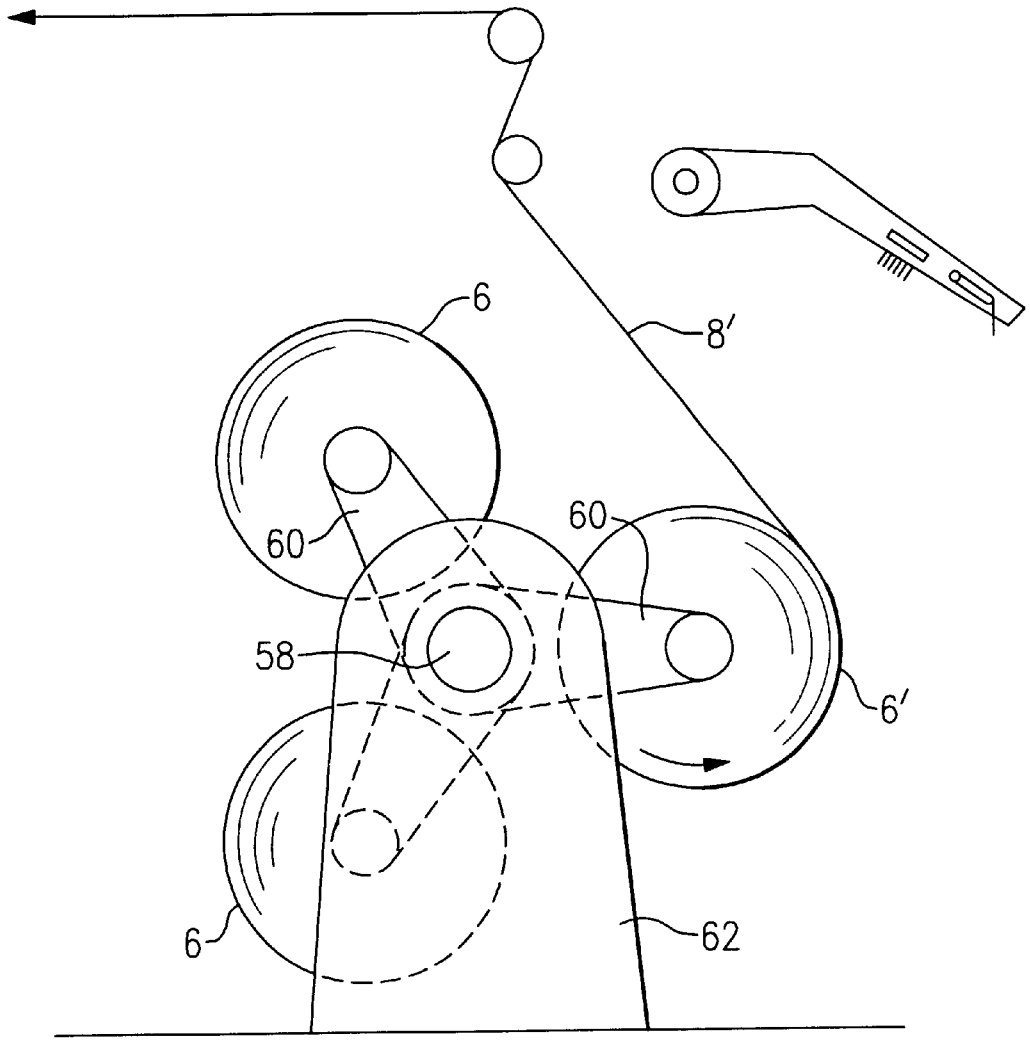
FIG. 30 to FIG. 34 are explanatory views showing the steps of joining two webs of paper together, respectively.

FIG. 30 illustrates the apparatus for feeding the web of paper 8, 8'. The apparatus comprises a shaft 58 including three reel arms 60 and supported on side frames 62 for rotation. The reel arms 60 each includes roll 6, 6' mounted at the end thereof for rotation, the web of paper 8' being fed from the roll 6'.

Figure 31:
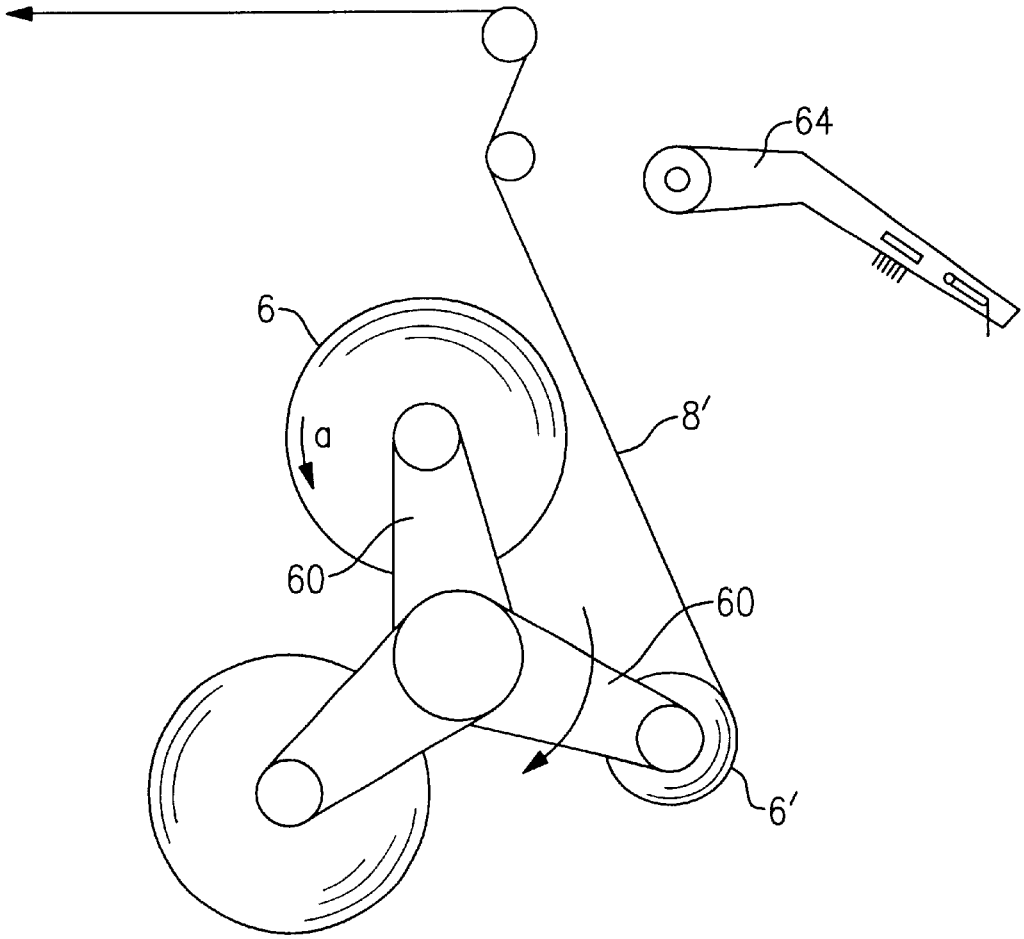
Figure 32:
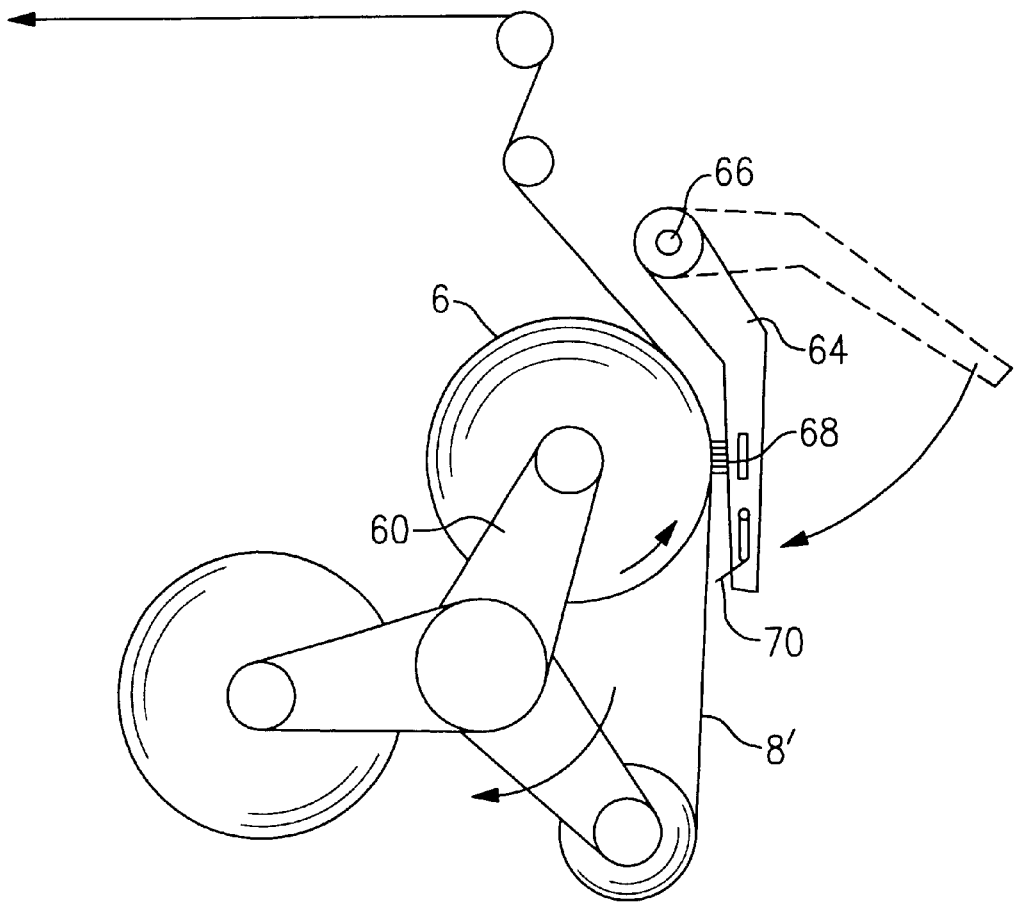

The apparatus further includes drive means connected to the shaft 58 for swingingly moving the reel arms 60 clockwise about the shaft 58 when the roll 6' decreases in diameter, as shown in FIG. 31, so that the roll 6 approaches the web of paper 8' from the roll 6'. The apparatus further includes drive means for rotatingly moving the roll 6 counterclockwise about the central axis thereof. A sensor detects if the residual of the web of paper 8' decreases to a small amount on the roll 6', to generate a signal. The drive means swingingly moves the reel arms 60 again in response to the signal from the sensor, so that the roll 6 engages with the web of paper 8', as shown in FIG. 32.

Figure 33:
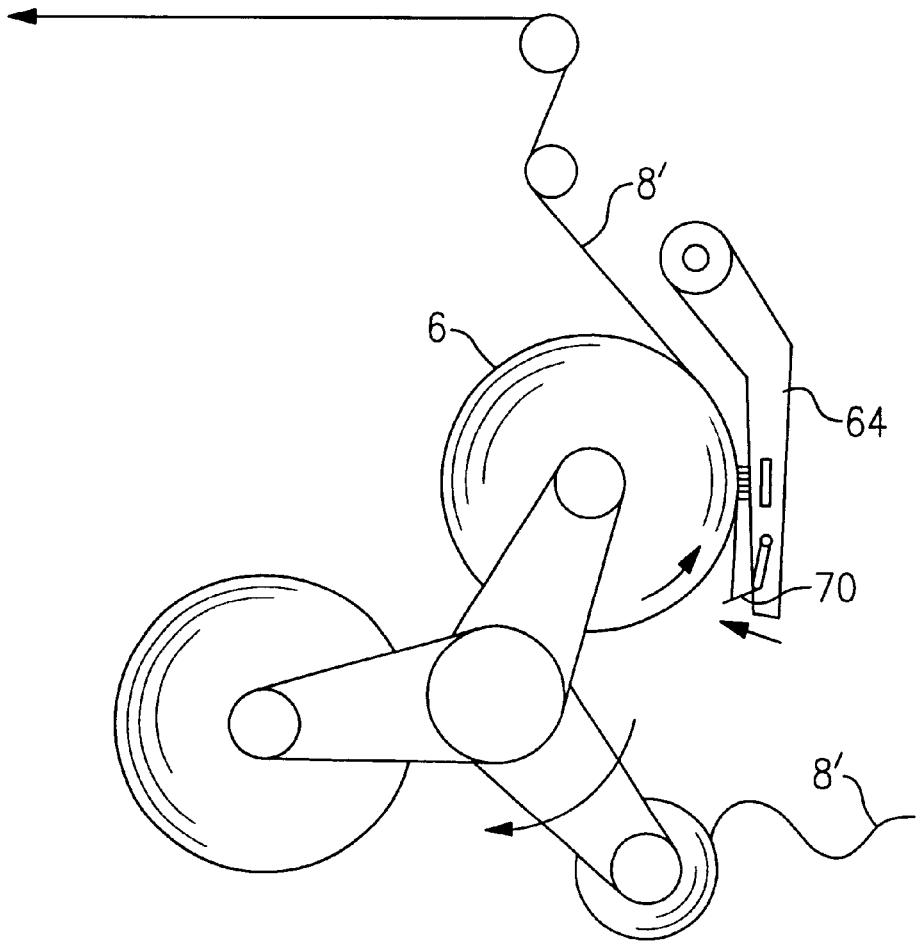

The apparatus further includes drive means for swingingly moving a paster arm 64 clockwise about a pin 66 toward the roll 6, the paster arm 64 including a brush 68 mounted thereon, so that the web of paper 81 is pressed against the outer surface of the roll 6 by the brush 68. The web of paper 8' is therefore adhered to the adhesive double coated tape 40 on the roll 6 to join the two webs of paper 8, 8' together. The paster arm 64 further includes a knife 70 which is connected to drive means mounted on the paster arm 64. The knife 70 is pressed against the web of paper 8' by the drive means to cut the web of paper 8', immediately after joining the two webs of paper 8, 8' together, as shown in FIG. 33.

Figure 34:
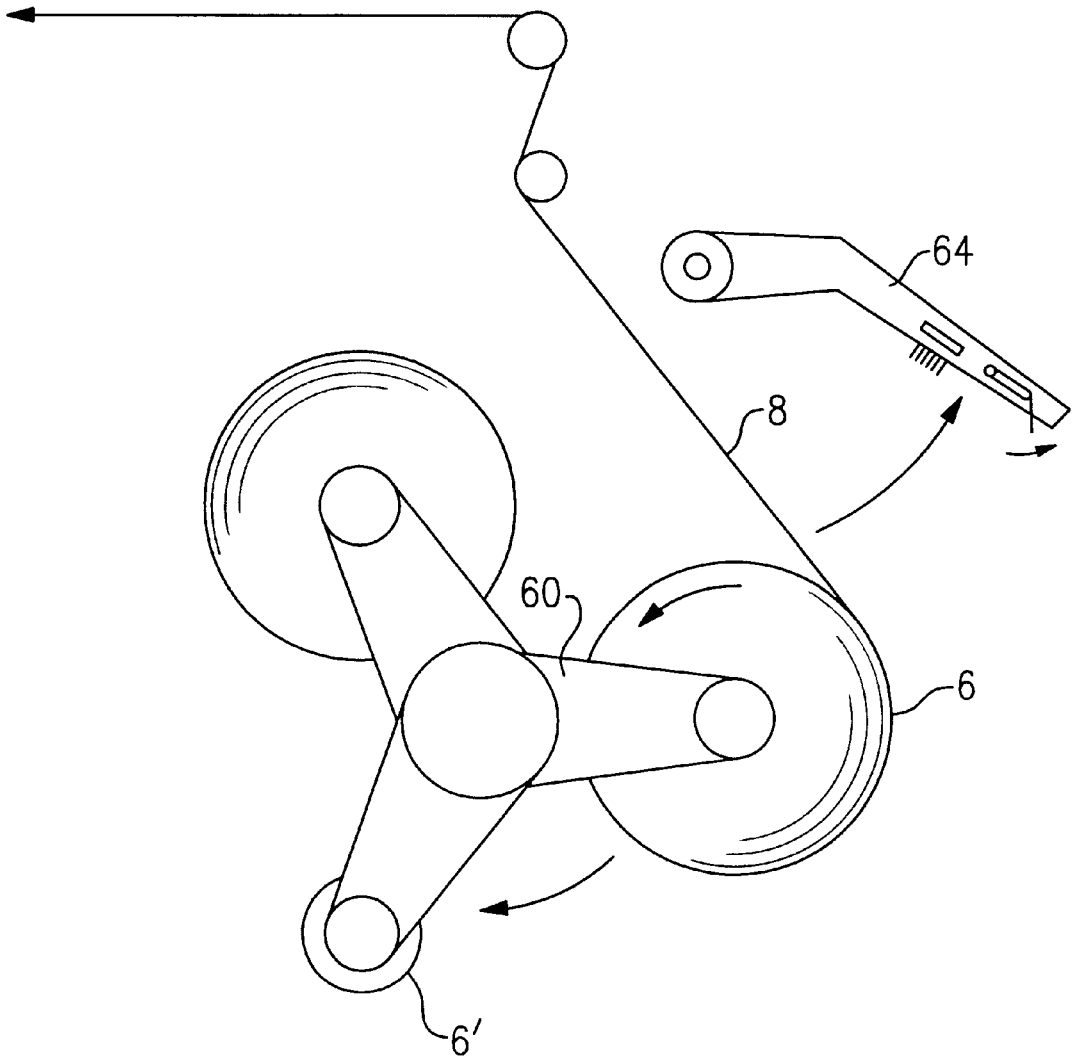
Figure 35:
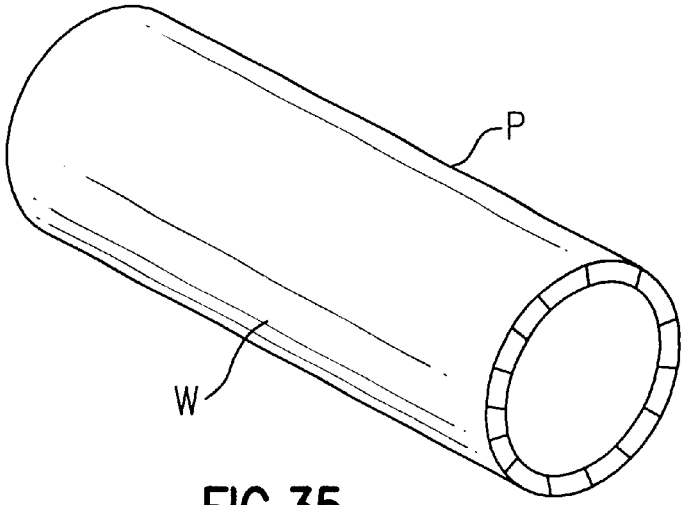
FIG.35 Prior Art
FIG. 35 is a perspective view of a package in prior art.
Figure 36:
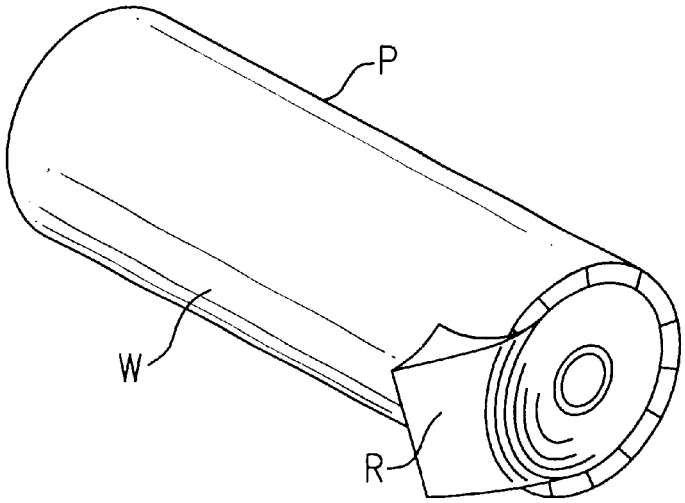
FIG.36 Prior Art
FIG. 36 is a perspective view of the package of FIG. 35 in which an end paper is removed and a wrapper is partially broken to show a roll wrapped with a wrapper.

The drive means then swingingly moves the paster arm 64 back to the position in FIG. 30 and swingingly moves the reel arms 60 again to the position in which the web of paper 8 is fed from the roll 6, as shown in FIG. 34.

What is claimed is:

1. An adhesive double coated tape used for a roll which includes a web of paper wound thereon to be printed or converted, said adhesive double coated tape comprising:

an elongated substrate;

two adhesive layers formed on the opposite sides of said substrate;

a release agent double coated paper adhered to one of said adhesive layers, the other adhesive layer being adhered to the end of said web; and a covering layer formed on one of the opposite sides of said release agent double coated paper, said covering layer being of material having a low absorptivity with respect to a laser beam.

2. An adhesive double coated tape used for a roll which includes a web of paper wound hereon to be printed or converted, said adhesive double coated tape comprising:

an elongated substrate;

two adhesive layers formed on the opposite sides of said substrate;

a release agent double coated paper adhered to one of said adhesive layers, the other adhesive layer being adhered to the end of said web; and a covering layer formed on one of the opposite sides of said substrate, said covering layer being of material having a low absorptivity with respect to a laser beam.

3. The adhesive double coated tape of claim 1 wherein said laser beam comprises a $CO_2$ laser beam, and wherein said covering layer comprises a foil of metal such as aluminum.

4. The adhesive double coated tape of claim 1 wherein said covering layer is adhered to one of the opposite sides of said release agent double coated paper.

5. The adhesive double coated tape of claim 1 wherein said covering layer is coated on one of the opposite sides of said release agent double coated paper.

6. The adhesive double coated tape of claim 1 wherein said covering layer is vapor deposited on one of the opposite sides of said release agent double coated paper.

7. An adhesive double coated rape used for a roll which includes a web of paper wound thereon to be printed or converted, said adhesive double coated tape comprising:

an elongated substrate of material having a low absorptivity with respect to a laser beam;

two adhesive layers formed on the opposite sides of said substrate; and a release agent double coated paper adhered to one of said adhesive layers, the other adhesive layer being adhered to the end of said web.

8. The adhesive double coated tape of claim 7 wherein said laser beam comprises a $CO_2$ laser beam, and wherein said substrate is made of metal such as aluminum.

9. An adhesive double coated tape comprising:

an elongated substrate including a portion weakened to be torn along a straight tearing line extending longitudinally of the substrate adjacent to one edge thereof;

two adhesive layers formed on the opposite sides of the substrate, said substrate being free from one of the adhesive layers at least between said tearing line and said one edge of the substrate;

an elongated void formed in and clear of the other adhesive layer along said tearing line; and a release agent double coated paper adhered to said one of the adhesive layers.

10. The adhesive double coated tape of claim 2 wherein said laser beam comprises a $CO_2$ laser beam, and wherein said covering layer comprises a foil of metal such as aluminum.

11. The adhesive double coated tape of claim 2 wherein said covering layer is adhered to one of the opposite sides of said substrate.

12. The adhesive double coated tape of claim 2 wherein said covering layer is coated on one of the opposite sides of said substrate.

13. The adhesive double coated tape of claim 2 wherein said covering layer is vapor deposited on one of the opposite sides of said substrate.

14. The adhesive double coated tape of claim 9 wherein a covering layer is formed on one of the opposite sides of said release agent double coated paper, said covering layer being of material having a low absorptivity with respect to a laser beam.

15. The adhesive double coated tape of claim 9 wherein a covering layer is formed on one of the opposite sides of said substrate, said covering layer being of material having a low absorptivity with respect to a laser beam.

16. The adhesive double coated tape of claim 9 wherein said substrate is of material having a low absorptivity with respect to a laser beam.

* * * * *